US007050005B2

(12) United States Patent
Göttl et al.

(10) Patent No.: US 7,050,005 B2
(45) **Date of Patent: *May 23, 2006**

(54) TWO-DIMENSIONAL ANTENNA ARRAY

(75) Inventors: Max Göttl, Frasdorf (DE); Jürgen Rumold, Bad Endorf (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/625,850

(22) Filed: Jul. 24, 2003

(65) Prior Publication Data

US 2004/0178964 A1 Sep. 16, 2004

Related U.S. Application Data

(63) Continuation-in-part of application No. 10/408,780, filed on Apr. 8, 2003, now Pat. No. 6,943,732.

(30) Foreign Application Priority Data

Dec. 5, 2002 (DE) ..... 102 56 960
Jul. 17, 2003 (DE) ..... 103 32 619

(51) Int. Cl.
*H01Q 1/38* (2006.01)

(52) U.S. Cl. ..... 343/700 MS; 343/893

(58) Field of Classification Search ..... 343/893, 343/853, 700 MS, 810, 797
See application file for complete search history.

(56) References Cited

U.S. PATENT DOCUMENTS 4,131,896 A * 12/1978 Miller ..... 343/815
4,937,585 A * 6/1990 Shoemaker ..... 343/853
6,211,841 B1 4/2001 Smith et al. ..... 343/853
6,313,809 B1 11/2001 Gabriel et al. ..... 343/797
6,351,243 B1 2/2002 Derneryd et al. .... 343/700 MS
6,646,611 B1 * 11/2003 Plet et al. ..... 343/702
6,819,300 B1 11/2004 Göttl ..... 343/799
2002/0021246 A1 2/2002 Martek et al. ..... 342/373
2002/0171601 A1 11/2002 Puente Baliarda ..... 343/893
2004/0145526 A1 * 7/2004 Puente Baliarda et al. ..... 343/700 MS

FOREIGN PATENT DOCUMENTS

DE 100 12 809 A1 9/2001
EP 0 888 649 B1 3/1997
EP 1 227 545 A1 7/2002
WO WO 00/39894 12/1999
WO WO 01/13459 2/2001
WO WO 02/05383 A1 1/2002
WO WO 02/084790 10/2002

* cited by examiner

*Primary Examiner*—Tuyet Vo
*Assistant Examiner*—Ephrem Alemu
(74) *Attorney, Agent, or Firm*—Nixon & Vanderhye P.C.

(57) ABSTRACT

An improved antenna array includes at least two vertically running gaps. There are overall at least two and preferably at least three radiators or radiator groups offset to one another in the vertical direction in one gap and preferably in all gaps. In at least one gap, the arrangement is such that the radiators or radiator groups in this at least one gap except for at least one radiator or at least one radiator group are jointly supplied. This at least one radiator or at least one radiator group is supplied jointly with the radiators or radiator groups of an adjacent gap.

12 Claims, 3 Drawing Sheets

TWO-DIMENSIONAL ANTENNA ARRAY

This application is a continuation in part of patent application Ser. No. 10/408,780 filing Apr. 8, 2003 Now U.S. Pat. No. 6,943,732

FIELD

The technology herein relates to a two-dimensional antenna array.

BACKGROUND AND SUMMARY

U.S. Pat. No. 6,351,243 discloses an improved antenna array with which certain half-value widths are produced for the radiators or radiator groups in the individual gaps according to requirements.

The '243 patent proposes an exemplary illustrative non-limiting two-dimensional antenna array with the following features:

- there are at least two vertically running gaps,
- there are overall at least two and preferably at least three radiators or radiator groups offset to one another in the vertical direction in one gap and preferably in all gaps,
- in at least one gap the arrangement is such that the radiators or radiator groups in this at least one gap except for at least one radiator or at least one radiator group are jointly supplied, and
- this at least one radiator or at least one radiator group is supplied jointly with the radiators or radiator groups of an adjacent gap.

The most varied illustrative implementations and reversal possibilities for the aforementioned general principle are discussed below.

DETAILED DESCRIPTION

For the overall structure of the antenna arrays which are explained below in addition, reference is made to the disclosure contents of the basic German application 102 56 960.6 in its full scope and to the contents of this application.

Figure 1:
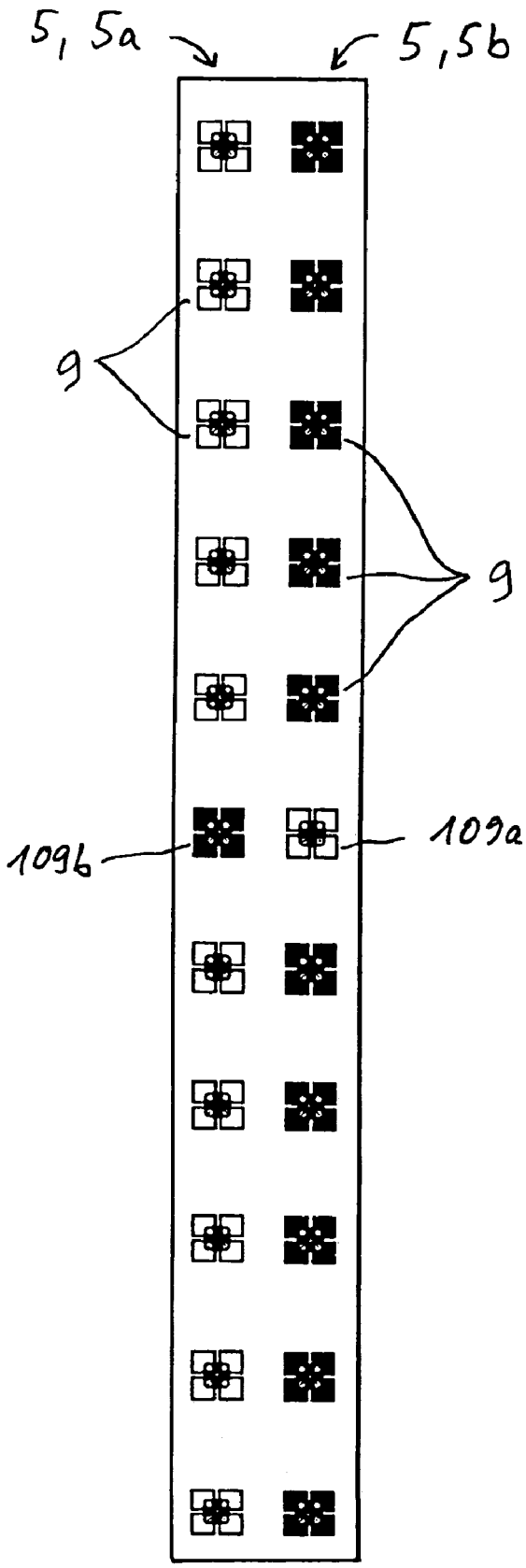
FIG. 1 shows another exemplary illustrative non-limiting implementation for a dual-gap antenna array.

In the exemplary illustrative non-limiting implementation shown in FIG. 1, there is an antenna array with two gaps 5, i.e. one gap 5*a* and one gap 5*b* in which there are a plurality of dual-polarized radiators 9 at a regular vertical distance over one another.

The radiators 9 which are shown as light in FIG. 1 in the left gap 5*a* are jointly supplied. In this exemplary illustrative non-limiting implementation, it is apparent that for the radiators in the left gap 5*a*—the middle in this exemplary illustrative non-limiting implementation but this is not absolutely necessary—one radiator 109*b* is shown which is drawn dark. In a conventional antenna array according to the prior art, this radiator 109*b* which is shown dark and which is reproduced in the left gap 5*a* in the middle would likewise be supplied with the other radiators in this gap 5*a*. Here the vertical distance between all the illustrated radiators 9 of the left gap 5*a* would be entirely or mostly at the same grid spacing vertically on top of one another. In contrast to the prior art, it is however provided here that the radiator which is provided in the middle in addition to the radiators 9 which are shown as light there and which are jointly supplied in the left gap 5*a* is not located in the left gap, but offset to it in the right gap 5*b* where it is identified with reference number 109*a* and is shown sitting in the right gap in the middle.

All the radiator elements which are sitting in the left gap 5*a* and which are shown as light are now jointly supplied with the radiator 109*a* which is located in the right gap 5*b* and which is likewise shown as light. The vertical grid sequence, i.e. the vertical distance, generally speaking therefore the vertical component of the three-dimensional distance between two adjacent jointly supplied radiators 9, 109 at a time, has therefore remained the same. This is because, proceeding from a conventional antenna array according to the prior art, only one radiator 109 has been taken and positioned in an adjacent gap 5*b*. Likewise all these radiators which are shown as light in FIG. 1 are jointly supplied.

The same applies to the radiators 9 which are shown in the illustrative non-limiting implementation illustrated in FIG. 1 for the right gap 5*b* and are drawn basically dark there. Ultimately, the exemplary illustrative non-limiting implementation as shown in FIG. 1 arises in that proceeding from a conventional radiator element, the radiators 109*a* and 109*b* which are positioned in a vertical line are not located in the gap in which they are jointly supplied with the remaining radiators 109. These two radiators 109*a*, 109*b* located on the same vertical line are interchanged in their position so that the radiator 109*a* which is jointly supplied with the radiators 9 which are located in the gap 5*a* now sits in another gap which is offset to it, generally in the adjacent gap 5*b*. Vice versa, the radiator 109*b* which is located with the radiators 9 which are jointly supplied in the right gap 5*b* is now positioned in the left gap. Likewise the exemplary illustrative non-limiting implementation shown in FIG. 1 could also be interpreted such that at least one pair of radiators 109*a*, 109*b* is fixed only on a common vertical line; and they are not jointly supplied with the radiators located in the same gap, but are jointly supplied alternately with the radiators in the adjacent group.

In contrast to the exemplary illustrative non-limiting implementation shown in FIG. 1, one other pair of radiators at a time on other vertical lines could also be taken, in which radiators the pertinent radiator is not jointly supplied with the other radiators located in the same gap, but with the radiators which are located in an adjacent gap.

In contrast to the exemplary illustrative non-limiting implementation shown in FIG. 1, the number of the radiators or radiator groups provided overall in each gap can be more or less than in the exemplary illustrative non-limiting implementation shown. Likewise, the number of radiators in the individual gaps can differ from one another. Even the type of radiator element used can be chosen to be different, for example in the form of a dipole cross, dipole square, a so-called vector dipole as is explained using the exemplary illustrative non-limiting implementation shown in FIG. 1. These radiators 109*a* and 109*b* sitting in another gap in FIG. 1 could also be located horizontally offset to the outside so that the total width of the antenna array would become twice as wide in this way. This may require unneeded installation space, for which reason the more efficient, space-saving approach is the one as is explained using FIG. 1. This is because the lateral offset of the radiators 109*a* and 109*b* can be undertaken there without needing additional installation space.

With the antenna array as shown in FIG. 1 (but basically also likewise with respect to FIG. 2 and FIG. 3 which are still to be explained), it is possible to use the jointly supplied radiators as an antenna which is operated separately from the jointly supplied radiators which are located mostly in another gap. Therefore, this is also possible since conventionally the jointly supplied radiators are sufficiently decoupled from the other radiators although they can ordinarily be used or operated in the same frequency band or frequency range. In the transmit mode, however, usually only one antenna is used. For example, the radiators 9 which are in the left gap 5*a* in FIG. 1 and shown as light there together with the radiators 109*a* are located in the right gap, positioned in the middle and shown likewise as light there. This at least one additional radiator unit 109*a* changes the beam width in the horizontal direction and the beam width can thus preferably be reduced. Without this at least one additional radiator unit 9*a* is located in the other gap, otherwise the half-value width of one such gap-shaped antenna structure would necessarily be between 80 to 100°, i.e. especially around 90°. This half-value width could essentially not be changed or reduced. Since the antenna arrays under consideration could preferably also be used as so-called smart antennas in which the radiators located in several gaps are used for beam shaping, in order to be able to adjust the major lobe of the antenna array in different azimuth directions, it is especially necessary for the horizontal distance of the centers of the radiators. Therefore, the horizontal distance between the vertical lines on which the radiators 9 are located in two adjacent gaps, to be roughly $\lambda/2$ (the deviation should preferably be less than ±20% or less than ±10% or even less than ±5%). This makes it difficult to reduce the radiation spectrum of an individual antenna to distinctly less than 90° half-value width. This is furthermore possible by the approach as claimed in exemplary illustrative non-limiting implementations with the arrangement of one or more radiators or radiator groups in an adjacent gap. In particular, in reception the antenna array can be operated likewise separately again with respect to the radiation of individual gaps or can be interconnected in several gaps.

Figure 2:
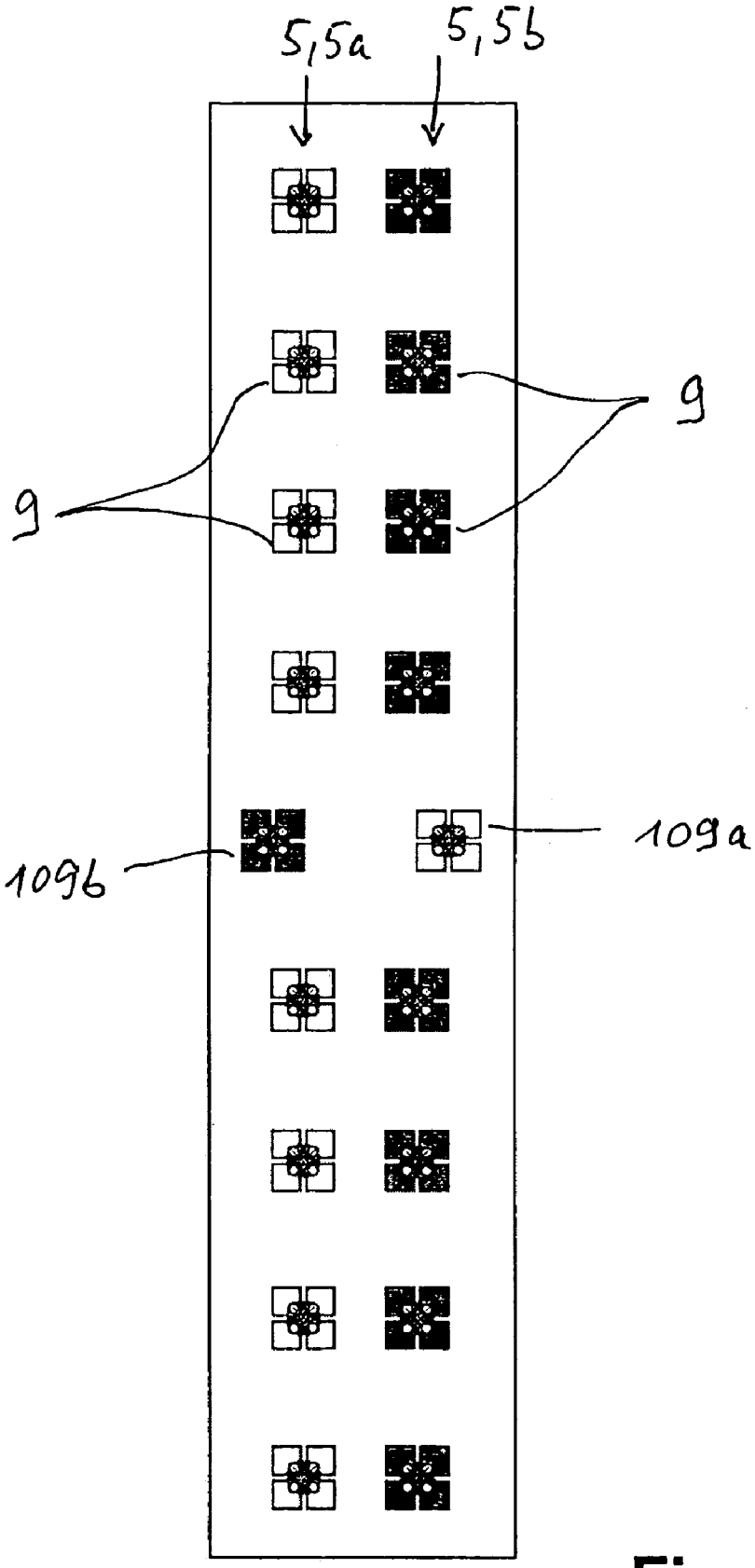
FIG. 2 shows an exemplary illustrative non-limiting implementation which has been slightly modified relative to FIG. 1.

FIG. 2 differs from FIG. 1 on the one hand only in that in one gap there are not eleven radiators on top of one another, but only nine. The number of radiators located on top of one another can differ arbitrarily anyway in the individual gaps.

Using FIG. 2, it has simply been shown that the horizontal offset of the two middle radiators 109*a* and 109*b* which are each supplied alternately with the radiators 9 in the gap which is the other one at the time, is greater than the horizontal distance of the remaining radiators which are located on a vertical line in the adjacent gaps. In this way, the horizontal beam spectrum can be influenced and changed. In the exemplary illustrative non-limiting implementation shown, the distance between the centers of the radiators located in the left and right gaps is roughly $\lambda/2$ or is in this range. That the distance between the radiators of the left and right gap can be for example less than $\lambda/2\pm20\%$ or preferably less than $\lambda/2\pm10\%$. At this point, the distance between the centers of the two radiators 109*a*, 109*b* which are offset to the outside and which are located in the middle is for example in the range between $\lambda/2$ and $\lambda$. The distance can also be chosen to be distinctly greater in order to implement different beam shaping widths.

Figure 3:
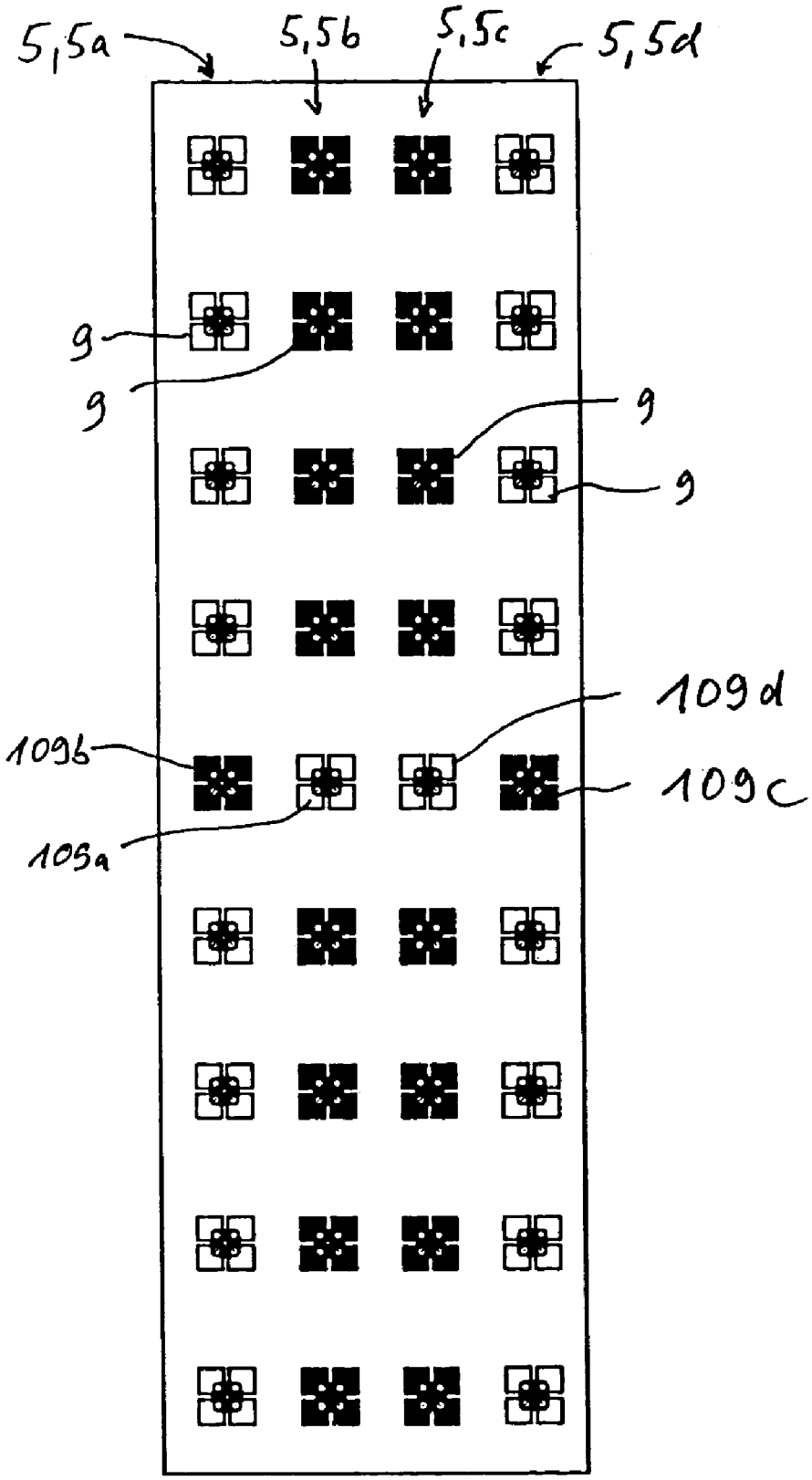
FIG. 3 shows one exemplary illustrative non-limiting implementation for a quadruple-gap antenna array.

FIG. 3 shows an example illustrative non-limiting implementation for a quadruple-gap antenna array with gaps 5*a*, 5*b*, 5*c*, and 5*d*. In each gap there is a total of 9 radiators.

Usually all radiators in one gap are supplied jointly. In this exemplary illustrative non-limiting implementations on the middle vertical line however, reversal of the feed in pairs has been undertaken such that the radiators 9 which are jointly supplied in the left gap 5*a* are not jointly supplied with the middle radiator 109*b* which is located in the left gap 5*a*, but with the radiator 109*a* which is provided on the same vertical line in the second gap 5*b*.

Conversely, the radiators 9 which are located in the second gap and which are shown dark are supplied jointly, but not with the radiator which is located in the middle. Here, joint feed takes place with the radiator 109*b* which is located in the first gap 5*a*.

Likewise, feed is undertaken reversed in the third and fourth gap 5*c*, 5*d*. Nor here are the radiators 9 shown as light in the gap 5*d* jointly supplied with the radiator 109*c* which is located in the middle in the same gap, but with the radiator 109*d* which is located in the middle in the third gap 5*c*. The radiators which are shown dark and which are located in the third gap 5*c* are then jointly supplied with the radiator unit 109*c* which is located in the middle of the antenna array in the gap 5*d*.

In this exemplary illustrative non-limiting implementation in turn, other pairs of radiators on other vertical lines can likewise be supplied reversed. Otherwise, all the radiators shown as light in FIG. 3 can also be jointly supplied and for example all the radiators shown dark can be jointly supplied.

In the illustrative non-limiting implementation as shown in FIG. 3, the distance between two horizontally adjacent radiators which are located in two different gaps is preferably $\lambda/2$. That is, in general the distance between the horizontally adjacent radiators is $\lambda/2\pm$ less than 20% or ± less than 10% difference therefrom.

Beam shaping within one gap can be preset differently with the simplest means by all these measures. This is because, depending on whether in one gap only some of the radiators provided there are jointly supplied and whether and if and how many other jointly supplied radiators are located in another gap, a horizontal pattern of differing width is achieved with respect to the gap of one such antenna array.

While the technology herein has been described in connection with exemplary illustrative non-limiting embodiments, the invention is not to be limited by the disclosure. The invention is intended to be defined by the claims and to cover all corresponding and equivalent arrangements whether or not specifically disclosed herein.

What is claimed is:

1. A two-dimensional antenna array defining at least two vertically running gaps, the antenna array comprising:

at least two radiators offset to one another in the vertical direction in at least one of said gaps, the radiators in said at least one gap except for at least one radiator being jointly fed, and said at least one radiator in at least one of said gaps being fed jointly with some but not all of the radiators of a gap adjacent to said at least one gap.

2. The antenna array as claimed in claim 1, wherein said jointly fed radiator is arranged such that the vertical distance is the same at a given horizontal offset.

3. The antenna array as claimed in claim 1, wherein said jointly fed radiator comprises plural radiators arranged offset to one another in the vertical direction such that the vertical distance is substantially the same between said plural radiators which are vertically offset to one another and/or are located horizontally at different heights.

4. The antenna array as claimed in claim 3, wherein the jointly fed radiator comprising plural radiators arranged offset to one another in the vertical direction such that the vertical distance is substantially the same between two radiators which are vertically offset to one another and/or the vertical distance of the radiators located horizontally at different heights.

5. The antenna array as claimed in claim 1, wherein the radiators are located in pairs on a common vertical line in at least two gaps.

6. The antenna array as claimed in claim 1, wherein the jointly fed radiator comprises plural radiators located at a regular vertical distance on top of one another including at least one radiator located with a horizontal offset to other jointly supplied radiators in a gap adjacent said at least one gap.

7. The antenna array as claimed in claim 1, defining at least two gaps, radiators within said at least two gaps being located at a regular vertical distance to one another and in the same vertical position in pairs, in said at least two gaps there being at least one pair of two radiators such that one radiator which is jointly supplied and located in the at least one gap is jointly supplied with at least one radiator of a gap adjacent thereto.

8. A two-dimensional antenna array comprising:

a structure defining at least first and second gaps extending vertically when the antenna is in use;

plural radiators disposed at least partially within said first gap, said plural radiators being offset from one another in the vertical direction; and at least one radiator at least partially disposed within said second gap, wherein at least one of said plural radiators within said first gap and said at least one radiator but not all of the radiators within said second gap are jointly fed.

9. A two-dimensional antenna array comprising:

a structure defining at least first and second columns extending vertically when the antenna is in use;

plural radiators disposed at least partially between said first column and said second column, said plural radiators being offset from one another in the vertical direction; and at least one further radiator at least partially disposed outside of a space between said first column and said second column, wherein at least one of said plural radiators and said at least one further radiator but not all of the further radiators are jointly fed.

10. The two-dimensional antenna array of claim 1 wherein said antenna array operates on only one band.

11. The two-dimensional antenna array of claim 8 wherein said antenna array operates on only one band.

12. The two-dimensional antenna array of claim 9 wherein said antenna array operates on only one band.

* * * * *